US010809027B2

(12) United States Patent
Michut

(10) Patent No.: US 10,809,027 B2
(45) Date of Patent: Oct. 20, 2020

(54) FIREARM MAGAZINE

(71) Applicant: Viktor Michut, Stiavnik (SK)

(72) Inventor: Viktor Michut, Stiavnik (SK)

( * ) Notice: Subject to any disclaimer, the term of this patent is extended or adjusted under 35 U.S.C. 154(b) by 0 days.

(21) Appl. No.: 16/468,044

(22) PCT Filed: Dec. 21, 2017

(86) PCT No.: PCT/SK2017/050011
§ 371 (c)(1),
(2) Date: Jun. 10, 2019

(87) PCT Pub. No.: WO2018/117982
PCT Pub. Date: Jun. 28, 2018

(65) Prior Publication Data

US 2020/0018563 A1 Jan. 16, 2020

(30) Foreign Application Priority Data

Dec. 21, 2016 (SK) ..... 50088-2016

(51) Int. Cl.
*F41A 9/70* (2006.01)

(52) U.S. Cl.
CPC ..... *F41A 9/70* (2013.01)

(58) Field of Classification Search
CPC ..... F41A 9/65; F41A 9/70; F41A 9/61
See application file for complete search history.

(56) References Cited

U.S. PATENT DOCUMENTS

| | | | | |
|---|---|---|---|---|
| 3,383,790 | A | 5/1968 | Into | |
| 3,603,020 | A | 9/1971 | Wiese | |
| 8,225,541 | B2 * | 7/2012 | Bigley | F41A 9/70 42/49.01 |
| 10,066,886 | B2 * | 9/2018 | Vilardi | F41A 9/69 |
| 2010/0281737 | A1 | 11/2010 | Cahill | |
| 2010/0313458 | A1 * | 12/2010 | Aalto | F41A 9/38 42/50 |
| 2016/0209140 | A1 | 7/2016 | Toth | |
| 2016/0282071 | A1 * | 9/2016 | Vilardi | F41A 9/65 |

FOREIGN PATENT DOCUMENTS

| | | | | |
|---|---|---|---|---|
| DE | 1080902 B * | 4/1960 | | F41S 9/65 |
| EP | 0154357 A2 | 9/1985 | | |

OTHER PUBLICATIONS

International Search Report and Written Opinion of the International Search Authority issued in PCT Application No. PCT/SK2017/050011 dated Apr. 5, 2018.

* cited by examiner

*Primary Examiner* — Benjamin P Lee
(74) *Attorney, Agent, or Firm* — LeonardPatel P.C.; Michael Aristo Leonard, II; Sheetal Suresh Patel

(57) ABSTRACT

A firearm magazine is provided that includes metal feed lips and a plastic body. In the upper part of the cavity of the plastic body of the magazine, a shoulder is included in which the metal feed lips are located. At least one vertical groove may be included on one of the walls of the shoulder of the plastic body. The metal feed lips are attached to the plastic body, potentially by at least one opening and by at least one corresponding projection, which may be formed on the adjacent walls of the plastic body and the feed lips.

18 Claims, 2 Drawing Sheets

[Fig. 1]
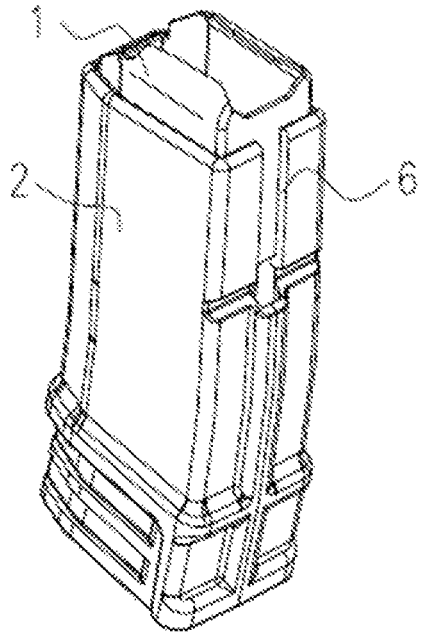
[Fig. 2]
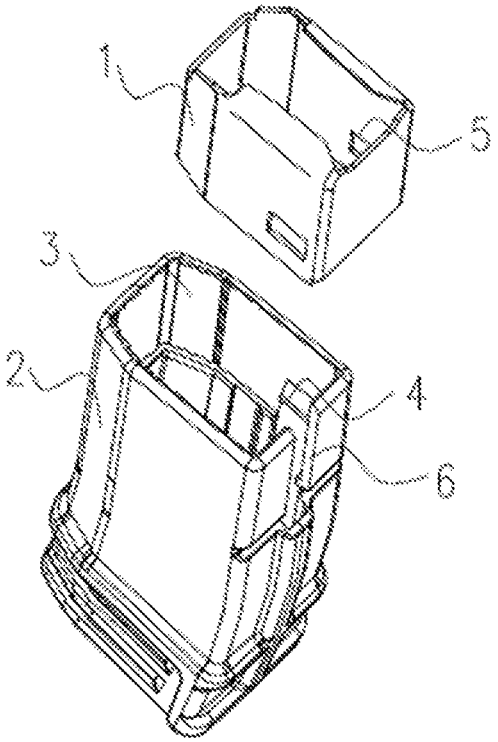

[Fig. 3]
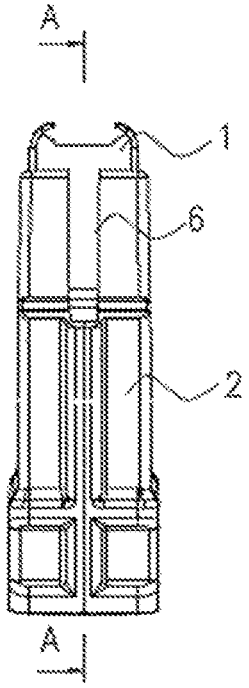
[Fig. 4]
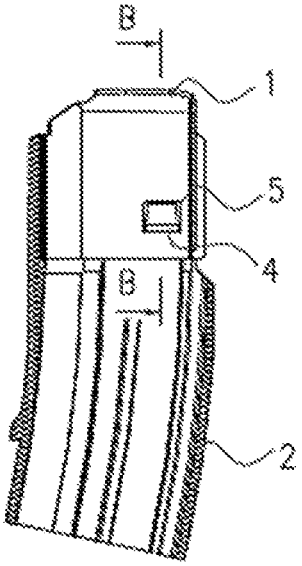
[Fig. 5]
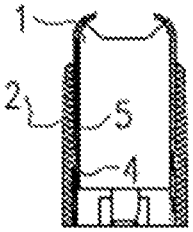

FIREARM MAGAZINE

CROSS REFERENCE TO RELATED APPLICATIONS

This application is a U.S. national stage application under 35 U.S.C. § 371 of PCT Application Number PCT/SK2017/050011 filed Dec. 21, 2017, which claims the benefit of Slovakian Patent Application Number PP 50088-2016 filed Dec. 21, 2016. The subject matter of these earlier filed patent applications is hereby incorporated by reference in its entirety.

FIELD

The invention generally pertains to firearms, and more particularly, to a firearm magazine that may be well suited for small caliber firearms.

BACKGROUND

For feeding ammunition into firearms, magazines are typically used. Based on the existing state of the art of magazine technology, in terms of design and materials, magazines can be divided into three main groups. The first group uses a metal sheet (steel or aluminum alloy) in the process of manufacturing the body of the magazine. Among the advantages of this group are relatively high rigidity, high durability, and a relatively long service life. However, disadvantages include its weight, technological complexity, and the necessity to apply a quality surface finish, which requires thermal treatment for reduction of friction and for improvement of corrosion resistance. From the point of view of the user, checking the current ammunition level of the magazine is also difficult.

The second group uses a plastic material in the process of manufacturing the body of the magazine. In addition to making it easy to check the current ammunition level of the magazine, provided that a suitable plastic material is used, advantages of this group include a relatively low price, as numerous technologies are not required that are included in the first group (e.g., thermal treatment, surface finish, calibration, etc.). Relatively low weight is another advantage. However, disadvantages include relatively low rigidity, relatively low durability, and a relatively short service life, especially due to wear of the feed lips of the magazine.

The third group, which has become more popular in recent years, combines the advantages of the previous two groups. Plastic materials are used to manufacture the body of the magazine, but the feed lips are made of metal. Designs where metal feed lips are implemented and molded in the outside of the plastic body, as described in U.S. Pat. No. 3,383,790, or are impressed directly in the molded plastic body, as described in EP 0154357 A2. However, this group has the disadvantage of a high degree of technological complexity.

These considerations gave rise to the task of searching for a design of a plastic magazine of a firearm that will simplify its manufacturing process and improve its service life, especially in the area of its feed lips. Accordingly, an improved design facilitating these features may be beneficial.

SUMMARY

Certain embodiments of the present invention may provide solutions to the problems and needs in the art that have not yet been fully identified, appreciated, or solved by current firearm magazine technologies. For example, some embodiments of the present invention pertain to a firearm magazine having a plastic body and metal feed lips. The upper part of the plastic body may have a shoulder for implementing the metal feed lips.

In some embodiments, at least one vertical groove is included on one of the walls of the shoulder of the plastic body. This ensures easier magazine assembly and prevents the plastic body from cracking due to aging of the plastic material. The location of the at least one vertical groove on the wall of the shoulder of the plastic body advantageously causes the at least one vertical groove to advantageously face the slide stop of the firearm after inserting the magazine into the firearm. This positioning of the vertical groove creates space for the slide stop of the firearm after firing the last cartridge of the magazine.

The metal feed lips are attached to the plastic body in some embodiments by at least one opening and by at least one corresponding projection on the adjacent walls of the plastic body and the feed lips. In certain embodiments, the metal feed lips are molded in the plastic body. Some advantages of the firearm magazine of some embodiments include, but are not limited to, simplifying the manufacturing process and improving the service life of the magazine, especially in the area of its feed lips.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which:

FIG. 1 illustrates a perspective view of an assembled magazine, according to an embodiment of the present invention.

FIG. 2 illustrates a perspective view of the metal lips and the plastic body of the magazine before assembly, according to an embodiment of the present invention.

FIG. 3 illustrates a front view of the assembled magazine from the side of the vertical groove created on the shoulder of the plastic body, according to an embodiment of the present invention.

FIG. 4 illustrates a longitudinal section of the magazine at the A-A position of FIG. 3, according to an embodiment of the present invention.

FIG. 5 illustrates a cross-section of the magazine at the B-B position of FIG. 4, according to an embodiment of the present invention.

DETAILED DESCRIPTION OF THE EMBODIMENTS

Some embodiments of the present invention pertain to a firearm magazine having a plastic body and metal feed lips. Referring to FIGS. 1-5, the body of the magazine of the firearm includes two parts, namely, metal feed lips 1 and a plastic body 2. The metal feed lips 1 are placed on a shoulder 3 in the upper part of the cavity of plastic body 2. The plastic body 2 and the metal feed lips 1 are attached, according to this example embodiment, by means of two projections 4 located in the shoulder 3 of the plastic body 2 of the magazine, and by means of two openings 5 created in the metal feed lips 1 that the projections 4 will slide into after inserting the metal feed lips 1 into the shoulder 3 of the plastic body 2 of the magazine.

Attaching the plastic body 2 and the metal feed lips can be performed in the opposite manner in some embodiments, whereby the openings 5 are created on the plastic body 2 and the projections 4 are created on the metal feed lips 1. It is also possible to attach the plastic body 2 and the metal feed lips 1 using a binder or glue, or by pressing the metal feed lips 1 directly into the plastic body 2 in a mold during molding of the plastic body 2. There is a vertical groove 6 on one of the walls of the shoulder 3 of the plastic body 2 in this example embodiment which, after inserting the magazine into the firearm, advantageously faces the slide stop (not shown) of the firearm.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A firearm magazine, comprising:

a plastic body comprising a cavity and a shoulder in an upper part of the cavity;

one or more grooves located on a wall of the shoulder of the plastic body; and metal feed lips, the metal feed lips located on the shoulder, wherein the metal feed lips project at least partially out of the cavity of the plastic body of the firearm magazine in a direction towards where the firearm magazine is inserted into a firearm, the one or more grooves are vertical grooves, and the one or more grooves are configured such that the one or more grooves face a slide stop of the firearm after being inserted into the firearm.

2. The firearm magazine of claim 1, wherein the plastic body comprises one or more projections on at least one wall, the metal feed lips comprise one or more corresponding openings for each of the one or more projections, each opening is located on a wall of the metal feed lips adjacent to a wall of the plastic body on which the corresponding projection is located.

3. The firearm magazine of claim 2, wherein the metal feed lips are attached to the plastic body via the one or more openings of the metal feed lips and the one or more corresponding projections of the plastic body.

4. The firearm magazine of claim 1, wherein the plastic body comprises one or more openings on at least one wall, the metal feed lips comprise one or more corresponding projections for each of the one or more openings, each projection is located on a wall of the metal feed lips adjacent to a wall of the plastic body on which the corresponding opening is located.

5. The firearm magazine of claim 4, wherein the metal feed lips are attached to the plastic body via the one or more projections of the metal lips and the one or more corresponding openings of the plastic body.

6. The firearm magazine of claim 1, wherein the metal feed lips are embedded in the plastic body.

7. The firearm magazine of claim 1, wherein the one or more grooves are located on a rear wall of the shoulder of the plastic body with respect to a frame of reference where a rear of a bullet faces the rear wall of the shoulder of the plastic body when loaded into the firearm magazine.

8. The firearm magazine of claim 1, wherein the one or more grooves are defined by a gap in a wall of the shoulder of the plastic body.

9. The firearm magazine of claim 8, wherein the one or more grooves are also defined by a gap in a lip at a top of the wall of the shoulder of the plastic body.

10. The firearm magazine of claim 9, wherein the wall is a rear wall of the shoulder of the plastic body with respect to a frame of reference where a rear of a bullet faces the rear wall of the shoulder of the plastic body when loaded into the firearm magazine.

11. A firearm magazine, comprising:

a plastic body comprising a cavity and a shoulder in an upper part of the cavity; and one or more grooves located on a wall of the shoulder of the plastic body; and metal feed lips, the metal feed lips located on the shoulder, wherein the shoulder is formed in an inside of an upper portion of the plastic body an defines an upper portion of the cavity, the one or more grooves are configured such that the one or more grooves face a slide stop of the firearm after being inserted into the firearm, and the one or more grooves are vertical grooves.

12. The firearm magazine of claim 11, wherein the plastic body comprises one or more projections on at least one wall, the metal feed lips comprise one or more corresponding openings for each of the one or more projections, each opening is located on a wall of the metal feed lips adjacent to a wall of the plastic body on which the corresponding projection is located.

13. The firearm magazine of claim 12, wherein the metal feed lips are attached to the plastic body via the one or more openings of the metal lips and the one or more corresponding projections of the plastic body.

14. The firearm magazine of claim 11, wherein the plastic body comprises one or more openings on at least one wall, the metal feed lips comprise one or more corresponding projections for each of the one or more openings, each projection is located on a wall of the metal feed lips adjacent to a wall of the plastic body on which the corresponding opening is located.

15. The firearm magazine of claim 14, wherein the metal feed lips are attached to the plastic body via the one or more projections of the metal lips and the one or more corresponding openings of the plastic body.

16. The firearm magazine of claim 11, wherein the metal feed lips are embedded in the plastic body.

17. A firearm magazine, comprising:

a plastic body comprising a cavity and a shoulder in an upper part of the cavity;

one or more grooves located on a wall of the shoulder of the plastic body and one or more projections on at least one wall of the plastic body; and metal feed lips located on the shoulder, wherein a bottom surface of the metal feed lips is adjacent to the shoulder of the plastic body, the one or more grooves are configured such that the one or more grooves face a slide stop of the firearm after being inserted into the firearm, and the one or more grooves are vertical grooves.

18. The firearm magazine of claim 17, further comprising:

one or more projections on at least one wall of the plastic body, wherein the metal feed lips comprise one or more corresponding openings for each of the one or more projections, each opening is located on a wall of the metal feed lips adjacent to a wall of the plastic body on which the corresponding projection is located, and the metal feed lips are attached to the plastic body via the one or more openings of the metal lips and the one or more corresponding projections of the plastic body.

* * * * *